US008685119B2

(12) United States Patent
Van Den Berg et al.

(10) Patent No.: US 8,685,119 B2
(45) **Date of Patent: *Apr. 1, 2014**

(54) METHOD AND SYSTEM FOR PRODUCING SYNTHESIS GAS, GASIFICATION REACTOR, AND GASIFICATION SYSTEM

(75) Inventors: Robert Erwin Van Den Berg, Amsterdam (NL); Franciscus Gerardus Van Dongen, Amsterdam (NL); Thomas Paul Von Kossak-Glowczewski, Gummersbach (DE); Henrik Jan Van Der Ploeg, Badhuisweg (NL); Pieter Lammert Zuideveld, Amsterdam (NL)

(73) Assignee: Shell Oil Company, Houston, TX (US)

( * ) Notice: Subject to any disclaimer, the term of this patent is extended or adjusted under 35 U.S.C. 154(b) by 1723 days.

This patent is subject to a terminal disclaimer.

(21) Appl. No.: 11/416,432

(22) Filed: May 2, 2006

(65) Prior Publication Data

US 2006/0260191 A1 Nov. 23, 2006

(30) Foreign Application Priority Data

May 2, 2005 (EP) ..... 05103619

(51) Int. Cl.
*B01J 7/00* (2006.01)

(52) U.S. Cl.
USPC ..... 48/61

(58) Field of Classification Search
USPC ..... 48/197 R
See application file for complete search history.

(56) References Cited

U.S. PATENT DOCUMENTS

| | | | | | |
|---|---|---|---|---|---|
| 3,988,421 | A | | 10/1976 | Rinaldi | 423/210 |
| 4,054,424 | A | | 10/1977 | Staudinger et al. | 48/210 |
| 4,315,758 | A | * | 2/1982 | Patel et al. | 48/197 R |
| 4,377,394 | A | * | 3/1983 | Muenger et al. | 48/62 R |
| 4,476,683 | A | * | 10/1984 | Shah et al. | 60/648 |
| 4,478,608 | A | * | 10/1984 | Dorling et al. | 48/210 |
| 4,487,611 | A | * | 12/1984 | Ziegler | 48/69 |
| 4,494,963 | A | * | 1/1985 | Reich | 48/69 |
| 4,510,874 | A | | 4/1985 | Hasenack | 110/347 |
| 4,523,529 | A | | 6/1985 | Poll | 110/263 |
| 4,775,392 | A | | 10/1988 | Cordier et al. | 48/92 |
| 4,848,982 | A | * | 7/1989 | Tolle et al. | 48/69 |
| 4,887,962 | A | | 12/1989 | Hasenack et al. | 110/263 |
| 4,950,308 | A | * | 8/1990 | Lang et al. | 48/62 R |
| 5,011,507 | A | * | 4/1991 | Stil et al. | 48/62 R |
| 5,188,805 | A | * | 2/1993 | Sabottke | 422/111 |
| 5,415,673 | A | * | 5/1995 | Hilton et al. | 48/197 R |
| 5,445,658 | A | * | 8/1995 | Durrfeld et al. | 48/62 R |
| 5,534,659 | A | | 7/1996 | Springer et al. | 588/205 |
| 5,803,937 | A | * | 9/1998 | Hartermann et al. | 48/210 |

(Continued)

FOREIGN PATENT DOCUMENTS

| | | | |
|---|---|---|---|
| EP | 400740 | 12/1990 | C10J 3/48 |
| EP | 0416242 | 3/1991 | |

(Continued)

*Primary Examiner* — Imran Akram

(57) ABSTRACT

A method and system for producing synthesis gas comprising CO, $CO_2$, and $H_2$ from a carbonaceous stream using an oxygen containing stream. A stream containing a carbonaceous material, and a stream containing oxygen are injected into a gasification reactor, where the carbonaceous stream is partially oxidized to obtain a raw synthesis gas. The raw synthesis gas is removed from the gasification reactor and directed into a quenching section wherein a liquid, preferably water, is injected in the form of a mist.

22 Claims, 4 Drawing Sheets

(56) References Cited

U.S. PATENT DOCUMENTS

| | | | | |
|---|---|---|---|---|
| 5,976,203 | A * | 11/1999 | Deeke et al. | 48/62 R |
| 6,453,830 | B1 * | 9/2002 | Zauderer | 110/345 |
| 6,755,980 | B1 | 6/2004 | Van Den Born et al. | 210/767 |
| 2004/0120874 | A1 * | 6/2004 | Zauderer | 423/242.1 |
| 2006/0070383 | A1 * | 4/2006 | Drnevich et al. | 60/775 |
| 2006/0076272 | A1 * | 4/2006 | Stil | 208/340 |
| 2007/0028522 | A1 * | 2/2007 | Mizusawa et al. | 48/127.9 |
| 2007/0062117 | A1 * | 3/2007 | Schingnitz et al. | 48/210 |
| 2007/0137103 | A1 * | 6/2007 | Wallace | 48/111 |
| 2007/0137107 | A1 * | 6/2007 | Barnicki | 48/198.3 |
| 2007/0294943 | A1 * | 12/2007 | Van Den Berg et al. | 48/208 |

FOREIGN PATENT DOCUMENTS

| | | | | |
|---|---|---|---|---|
| EP | 0379022 | B1 | 12/1991 | C10K 1/06 |
| EP | 0551951 | B1 | 7/1995 | B01D 46/24 |
| EP | 0662506 | | 7/1995 | C10J 3/84 |
| EP | 0926441 | B1 | 12/2002 | F23G 5/32 |
| EP | 1499418 | B1 | 1/2006 | B01D 46/24 |
| WO | WO 9317759 | | 9/1993 | A62D 3/00 |
| WO | 2004/005438 | | 1/2004 | C10J 3/46 |
| WO | WO2005052095 | A1 | 6/2005 | C10J 3/52 |

* cited by examiner

METHOD AND SYSTEM FOR PRODUCING SYNTHESIS GAS, GASIFICATION REACTOR, AND GASIFICATION SYSTEM

CROSS REFERENCE TO EARLIER APPLICATIONS

This application claims priority under 35 USC §119 of European patent application number 05103619.2, filed May 2, 2005.

FIELD OF THE INVENTION

In one aspect, the present invention relates to a method of producing synthesis gas comprising CO, $CO_2$, and $H_2$ from a carbonaceous stream using an oxygen containing stream.

In another aspect, the invention relates to a gasification reactor for performing said method.

In still another aspect, the invention relates to a gasification system comprising a gasification reactor.

In still another aspect, the invention relates to a system for producing a synthesis gas.

BACKGROUND OF THE INVENTION

Methods for producing synthesis gas are well known from practice.

An example of a method for producing synthesis gas is described in EP-A-0 400 740.

Generally, a stream containing a carbonaceous material, such as coal, brown coal, peat, wood, coke, soot, or other gaseous, liquid or solid fuel or mixture thereof, is partially combusted in a gasification reactor using an oxygen containing gas such as substantially pure oxygen or (optionally oxygen enriched) air or the like, thereby obtaining a.o. synthesis gas (CO and $H_2$), $CO_2$ and a slag. The slag formed during the partial combustion drops down and is drained through an outlet located at or near the reactor bottom.

The hot product gas, i.e. raw synthesis gas, usually contains sticky particles that lose their stickiness upon cooling. These sticky particles in the raw synthesis gas may cause problems downstream of the gasification reactor where the raw synthesis gas is further processed, since undesirable deposits of the sticky particles on, for example, walls, valves or outlets may adversely affect the process. Moreover such deposits are hard to remove.

Therefore, the raw synthesis gas is quenched in a quench section which is located downstream of the gasification reactor. In the quench section a suitable quench medium such as water vapour is introduced into the raw synthesis gas in order to cool it.

A problem of producing synthesis gas is that it is a highly energy consuming process. Therefore, there exists a constant need to improve the efficiency of the process, while at the same time minimizing the capital investments needed.

SUMMARY OF THE INVENTION

In a first aspect, there is provided a method of producing synthesis gas comprising CO, $CO_2$, and $H_2$ from a carbonaceous stream using an oxygen containing stream, the method comprising the steps of:

(a) injecting a carbonaceous material containing stream and an oxygen containing stream into a gasification reactor;

(b) at least partially oxidising the carbonaceous stream in the gasification reactor, thereby obtaining a raw synthesis gas;

(c) removing the raw synthesis gas obtained in step (b) from the gasification reactor into a quenching section; and (d) injecting a liquid into the quenching section in the form of a mist.

In another aspect there is provided a system at least comprising:

- a gasification reactor having an inlet for an oxygen containing stream, an inlet for a carbonaceous stream, and downstream of the gasification reactor an outlet for raw synthesis gas produced in the gasification reactor;
- a quenching section connected to the outlet of the gasification reactor for the raw synthesis gas;

wherein the quenching section comprises at least one first injector adapted for injecting a liquid, preferably water, in the quenching section in the form of a mist.

Embodiments of this system are especially suitable for performing the method as summarized above.

In still another aspect, there is provided a gasification reactor comprising:

- a pressure shell for maintaining a pressure higher than atmospheric pressure;
- a slag bath located in a lower part of the pressure shell;
- a gasifier wall arranged inside the pre-s-sure shell defining a gasification chamber wherein during operation the synthesis gas can be formed, a lower open part of the gasifier wall which is in fluid communication with the slag bath and an open upper end of the gasifier wall which is in fluid communication with a quench zone;
- a quench zone comprising a tubular formed part positioned within the pressure shell, open at its lower and upper end and having a smaller diameter than the pressure shell thereby defining an annular space around the tubular part, wherein the lower open end is fluidly connected to the upper end of the gasifier wall and the upper open end is in fluid communication with the annular space;
- wherein at the lower end of the tubular part an injector is present for injecting a liquid or gaseous cooling medium and wherein in the annular space an injector is present to inject a liquid in the form of a mist and wherein an outlet for synthesis gas is present in the wall of the pressure shell fluidly connected to said annular space.

In an embodiment, the gasification reactor is especially suited for performing the method as summarized above.

In still another aspect, there is provided a gasification system comprising a gasification reactor and a quench vessel wherein the gasification reactor comprises:

- a pressure shell for maintaining a pressure higher than atmospheric pressure;
- a slag bath located in a lower part of the pressure shell;
- a gasifier wall arranged inside the pressure shell defining a gasification chamber wherein during operation the synthesis gas can be formed, a lower open part of the gasifier wall which is in fluid communication with the slag bath and an open upper end of the gasifier wall which is in fluid communication with a vertically extending tubular part, which tubular part is open at its lower and upper end, the upper end being in fluid communication with a synthesis gas inlet of the quench vessel and wherein the tubular part provided an injector to add a liquid or gaseous cooling medium at its lower end;

wherein the quench vessel is provided at its top end with a synthesis gas inlet, with an injector to inject a liquid in the form of a mist into the synthesis gas and with an outlet for synthesis gas.

Embodiments of the gasification system are especially suited for performing the method as summarized above.

BRIEF DESCRIPTION OF THE DRAWINGS

The invention will now be described by way of example in more detail with reference to the accompanying non-limiting drawings, wherein.

Same reference numbers as used below refer to similar structural elements.

DETAILED DESCRIPTION OF EMBODIMENTS

Figure 1:
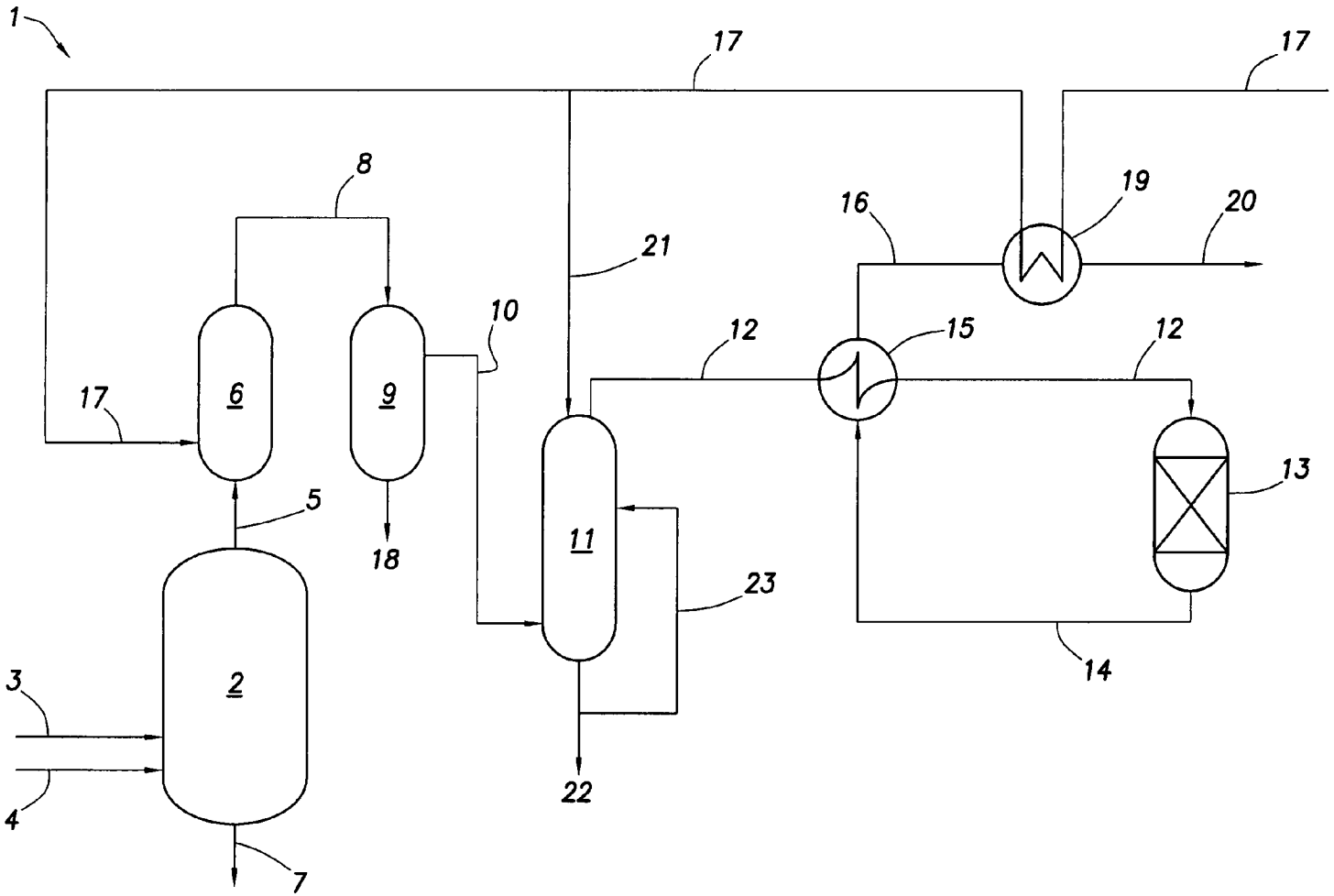
FIG. 1 schematically shows a process scheme for performing a method in accordance with embodiments of the invention.

Reference is made to FIG. 1. FIG. 1 schematically shows a system 1 for producing synthesis gas. In a gasification reactor 2 a carbonaceous stream and an oxygen containing stream may be fed via lines 3, 4, respectively. The term "carbonaceous stream" is used herein as short for any stream containing a carbonaceous material.

The carbonaceous stream is at least partially oxidised in the gasification reactor 2, thereby obtaining a raw synthesis gas and a slag. To this end, several burners (not shown) are typically present in the gasification reactor 2. Typically, the partial oxidation in the gasification is carried out at a temperature in the range from 1200 to 1800° C. and at a pressure in the range from 1 to 200 bar, preferably between 20 and 100 bar.

The produced raw synthesis gas is fed via line 5 to a quenching section 6; herein the raw synthesis gas is typically cooled to about 400° C. The slag drops down and is drained through line 7 for optional further processing.

The quenching section 6 may have any suitable shape, but will usually have a tubular form. Into the quenching section 6 a liquid is injected via line 17 in the form of a mist, as will be further discussed below and also with reference to FIG. 2.

It has surprisingly been found that by injecting a liquid in the form of a mist, the process as a whole may be performed more efficiently.

Further it has been found that the raw synthesis gas is cooled very efficiently, as a result of which less deposits of sticky particles downstream of the gasification reactor may occur.

The liquid may be any liquid having a suitable viscosity in order to be atomized. Non-limiting examples of the liquid to be injected include a hydrocarbon liquid, a waste stream, etc. In a preferred embodiment the liquid comprises water. The liquid may comprise at least 50% water. Preferably the liquid is substantially comprised of water (i.e. >95 vol %). The wastewater, also referred to as black water, as obtained in a possible downstream synthesis gas scrubber may be used as the liquid.

The person skilled in the art will readily understand what is meant by the terms 'carbonaceous stream', 'oxygen containing stream', 'gasification reactor' and 'quenching section'. Therefore, these terms will not be further discussed. As a carbonaceous stream a high carbon containing solid feedstock may be used. Preferably the stream is substantially (i.e. >90 wt. %) comprised of naturally occurring coal or synthetic cokes.

With the term 'raw synthesis gas' is meant that this product stream may—and usually will—be further processed, e.g. in a dry solid remover, wet gas scrubber, a shift converter or the like.

A fluid is understood to comprise liquid media and/or gaseous media.

With the term 'mist' is meant that the liquid is injected in the form of small droplets. The liquid may contain small amounts of vapour. If water is to be used as the liquid, then preferably more than 80%, more preferably more than 90%, of the water is in the liquid state.

The injected mist may have a temperature of at most 50° C. below the bubble point at the prevailing pressure conditions at the point of injection, particularly at most 15° C., even more preferably at most 10° C. below the bubble point. To this end, if the injected liquid is water, it may have a temperature of above 90° C., preferably above 150° C., more preferably from 200° C. to 230° C. The preferred temperature will depend on the operating pressure of the gasification reactor, i.e. the pressure of the raw synthesis as specified further below. Hereby a rapid vaporization of the injected mist is obtained, while cold spots are avoided. As a result the risk of ammonium chloride deposits and local attraction of ashes in the gasification reactor is reduced.

Further, it may be preferred that the mist comprises droplets having a diameter within a range from 50 to 200 μm, preferably from 100 to 150 μm. At least 80 vol. % of the injected liquid may be in the form of droplets having the indicated sizes.

To enhance quenching of the raw synthesis gas, the mist may be injected with a velocity of between 30 m/s and 90 m/s, preferably 40-60 m/s.

The mist may be injected with an injection pressure of at least 10 bar above the pressure of the raw synthesis gas, preferably from 20 to 60 bar, more preferably about 40 bar, above the pressure of the raw synthesis gas. If the mist is injected with an injection pressure of below 10 bar above the pressure of the raw synthesis gas, the droplets of the mist may become too large.

However, the latter may be at least partially offset by using an atomisation gas, which may e.g. be $N_2$, $CO_2$, steam or synthesis gas. Using atomisation gas has the additional advantage that the difference between injection pressure and the pressure of the raw synthesis gas may be reduced.

The amount of injected mist may be selected such that the raw synthesis gas leaving the quenching sections comprises at least 40 vol. % $H_2O$, preferably from 40 to 60 vol. % $H_2O$, more preferably from 45 to 55 vol. % $H_2O$.

In embodiments, the amount of water added relative to the raw synthesis gas is even higher than the preferred ranges above if one chooses to perform a so-called over-quench. In an over-quench type process the amount of water added is such that not all liquid water will evaporate and some liquid water will remain in the cooled raw synthesis gas. Such a process may be advantageous because a downstream dry solid removal system can be omitted. In such a process the raw synthesis gas leaving the gasification reactor is saturated with water. The ratio of the raw synthesis gas and water injection may be 1:1 to 1:4.

It has been found that herewith the capital costs can be substantially lowered, as no further addition of water downstream of the gasification reactor may be necessary.

Further it has been found especially suitable when the mist is injected in a direction away from the gasification reactor, or said otherwise when the mist is injected in the flow direction of the raw synthesis gas. Thereby no or less dead spaces occur which might result in local deposits on the wall of the quenching section. The mist may be injected under an angle of between 30-60°, more preferably about 45°, with respect to a plane perpendicular to the longitudinal axis of the quenching section.

In various embodiments, the injected mist is at least partially surrounded by a shielding fluid. Herewith the risk of forming local deposits is reduced. The shielding fluid may be any suitable fluid, but is preferably selected from the group consisting of an inert gas such as $N_2$ and $CO_2$, synthesis gas, steam and a combination thereof.

The raw synthesis gas leaving the quenching section may further be shift converted whereby at least a part of the water is reacted with CO to produce $CO_2$ and $H_2$ thereby obtaining a shift converted synthesis gas stream. As the person skilled in the art will readily understand what is meant with "shift converting", this is not further discussed in high level of detail.

Before shift converting the raw synthesis gas, the raw synthesis gas may be heated in a heat exchanger against the shift converted synthesis gas stream. Herewith the energy consumption of the method may be further reduced. In this respect it is also an option that the mist is heated before injecting it in step (d) by indirect heat exchange against the shift converted synthesis gas stream.

Referring again to FIG. 1, the amount of mist to be injected in the quenching section 6 will depend on various conditions, including the desired temperature of the raw synthesis gas leaving the quenching section 6. In the present example, the amount of injected mist is selected such that the raw synthesis gas leaving the quenching section 6 has a $H_2O$ content of from 45 to 55 vol. %.

As shown in the embodiment of FIG. 1, the raw synthesis gas leaving the quenching section 6 is further processed. To this end, it is fed via line 8 into a dry solids removal unit 9 to at least partially remove dry ash in the raw synthesis gas. As the dry solids removal unit 9 is known per se, it is not further discussed here. Dry ash is removed from the dry solids removal unit via line 18.

After the dry solids removal unit 9 the raw synthesis gas may be fed via line 10 to a wet gas scrubber 11 and subsequently via line 12 to a shift converter 13 to react at least a part of the water with CO to produce $CO_2$ and $H_2$, thereby obtaining a shift converted gas stream in line 14. As the wet gas scrubber 11 and shift converter 13 are already known per se, they are not further discussed here in detail. Waste water from gas scrubber 11 is removed via line 22 and optionally partly recycled to the gas scrubber 11 via line 23.

It has surprisingly been found that by employing the present method the vol. % water of the stream leaving the quenching section 6 in line 8 may already be such that the capacity of the wet gas scrubber 11 may be substantially lowered, resulting in a significant reduction of capital expenses.

Further improvements may be achieved when the raw synthesis gas in line 12 is heated in a heat exchanger 15 against the shift converted synthesis gas in line 14 that is leaving the shift converter 13.

Energy contained in the stream of line 16 leaving heat exchanger 15 may be used to warm up the water in line 17 to be injected in quenching section 6. To this end, the stream in line 16 may be fed to an indirect heat exchanger 19, for indirect heat exchange with the stream in line 17.

As shown in the embodiment in FIG. 1, the stream in line 14 is first fed to the heat exchanger 15 before entering the indirect heat exchanger 19 via line 16. However, the person skilled in the art will readily understand that the heat exchanger 15 may be dispensed with, if desired, or that the stream in line 14 is first fed to the indirect heat exchanger 19 before heat exchanging in heat exchanger 15.

The stream leaving the indirect heat exchanger 19 in line 20 may be further processed, if desired, for further heat recovery and gas treatment.

If desired the heated stream in line 17 may also be partly used as a feed (line 21) to the gas scrubber 11.

Figure 2:
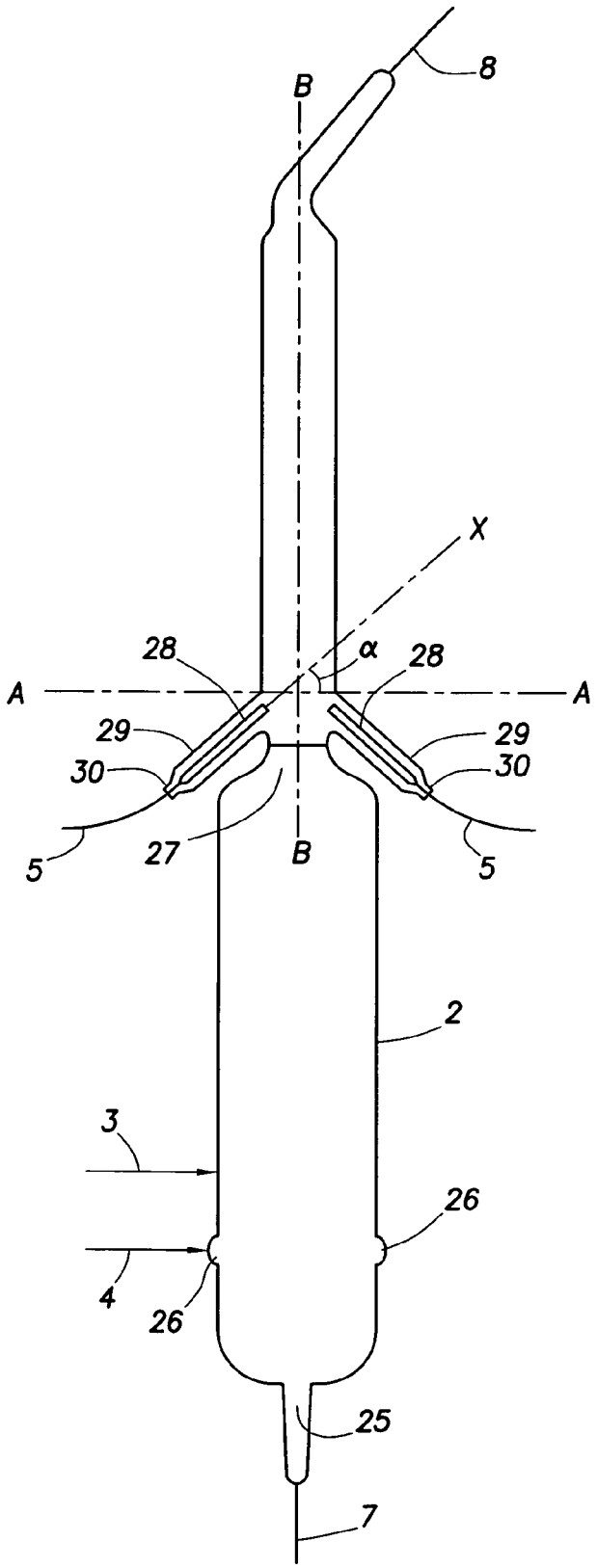
FIG. 2 schematically shows a longitudinal cross-section of a gasification reactor.

FIG. 2 shows a longitudinal cross-section of a gasification reactor 2 used in the system 1 of FIG. 1.

The gasification reactor 2 has an inlet 3 for a carbonaceous stream and an inlet 4 for an oxygen containing gas.

One or several burners (schematically denoted by 26) are present in the gasification reactor 2 for performing the partial oxidation reaction. For reasons of simplicity, two burners 26 are shown here.

Further, the gasification reactor 2 comprises an outlet 25 for removing the slag formed during the partial oxidation reaction via line 7.

Also, the gasification reactor 2 comprises an outlet 27 for the raw synthesis gas produced, which outlet 27 is connected with the quenching section 6. The skilled person will readily understand that between the outlet 27 and the quenching section 6 some tubing may be present (as schematically denoted with line 5 in FIG. 1). However, usually the quenching section 6 is directly connected to the gasification reactor 2, as shown in FIG. 2.

The quenching section 6 comprises a first injector 28 that is adapted for injecting a water containing stream in the form of a mist in the quenching section. The first injector 28 is connected to line 17. The person skilled in the art will readily understand how to select the first injector to obtain the desired mist. Also more than one first injector may be present.

The first injector injects the mist in a direction away from the gasification reactor, usually in a partially upward direction. As shown in FIG. 2, the first injector in use injects the mist in a direction away from the outlet 27 of the gasification reactor 2. To this end the centre line X of the mist injected by the first injector 28 forms an angle $\alpha$ of between 30-60°, preferably about 45°, with respect to the plane A-A perpendicular to the longitudinal axis B-B of the quenching section 6.

As shown in the embodiment of FIG. 2, the quenching section may further comprise a second injector 29 adapted for injecting a shielding fluid at least partially surrounding the mist injected by the at least one first injector 28. The second injector 29 is connected via line 30 to a source of shielding gas.

Also in this case the person skilled in the art will readily understand how to adapt the second injector to achieve the desired effect. For instance, the nozzle of the first injector may be partly surrounded by the nozzle of the second injector. As shown in the embodiment of FIG. 2 the first injector 28 is to this end partly surrounded by second injector 29.

The quenching section wherein the liquid mist is injected may be situated above, below or next to the gasification reactor, provided that it is downstream of the gasification reactor, as the raw synthesis gas produced in the gasification reactor is cooled in the quenching section. Preferably the quenching section is placed above the gasification reactor; to this end the outlet of the gasification reactor may be placed at the top of the gasification reactor.

As already discussed above in respect of FIG. 1, the raw synthesis gas leaving the quenching section 6 via line 8 may be further processed. In embodiments described below, the raw synthesis gas is cooled to a temperature below the solidification temperature of the non-gaseous components before injecting the liquid in the form of a mist according to the present invention.

The solidification temperature of the non-gaseous components in the raw synthesis gas may depend on the carbonaceous feedstock. The solidification temperature is typically between 600 and 1200° C., or between 500 and 1000° C., for coal type feedstocks.

This initial cooling may be performed by injecting synthesis gas, carbon dioxide or steam having a lower temperature than the raw synthesis gas, or by injecting a liquid in the form of a mist according to the present invention. In such a two-step cooling method step (b) may be performed in a downstream separate apparatus or more preferably within the same apparatus as in which the gasification takes place.

Figure 3:
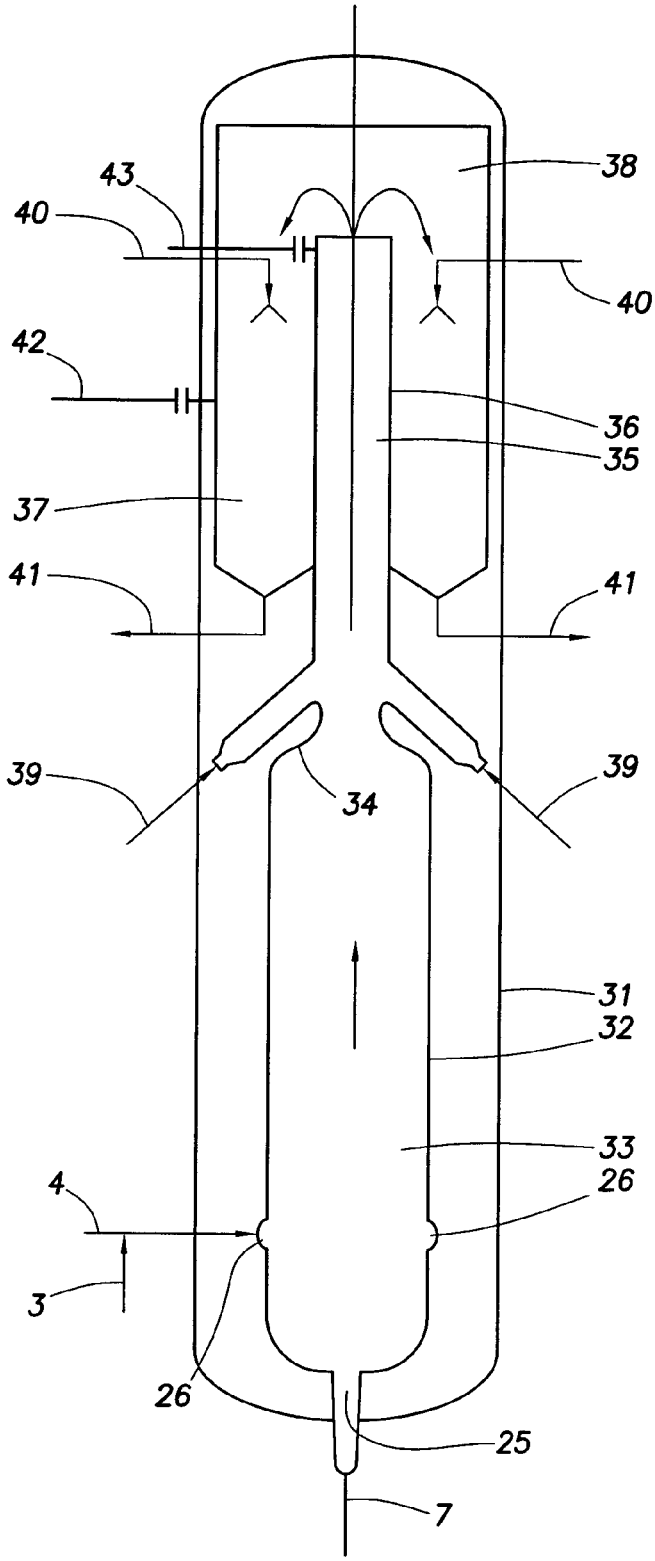
FIG. 3 schematically shows a longitudinal cross-section of a gasification reactor.
Figure 4:
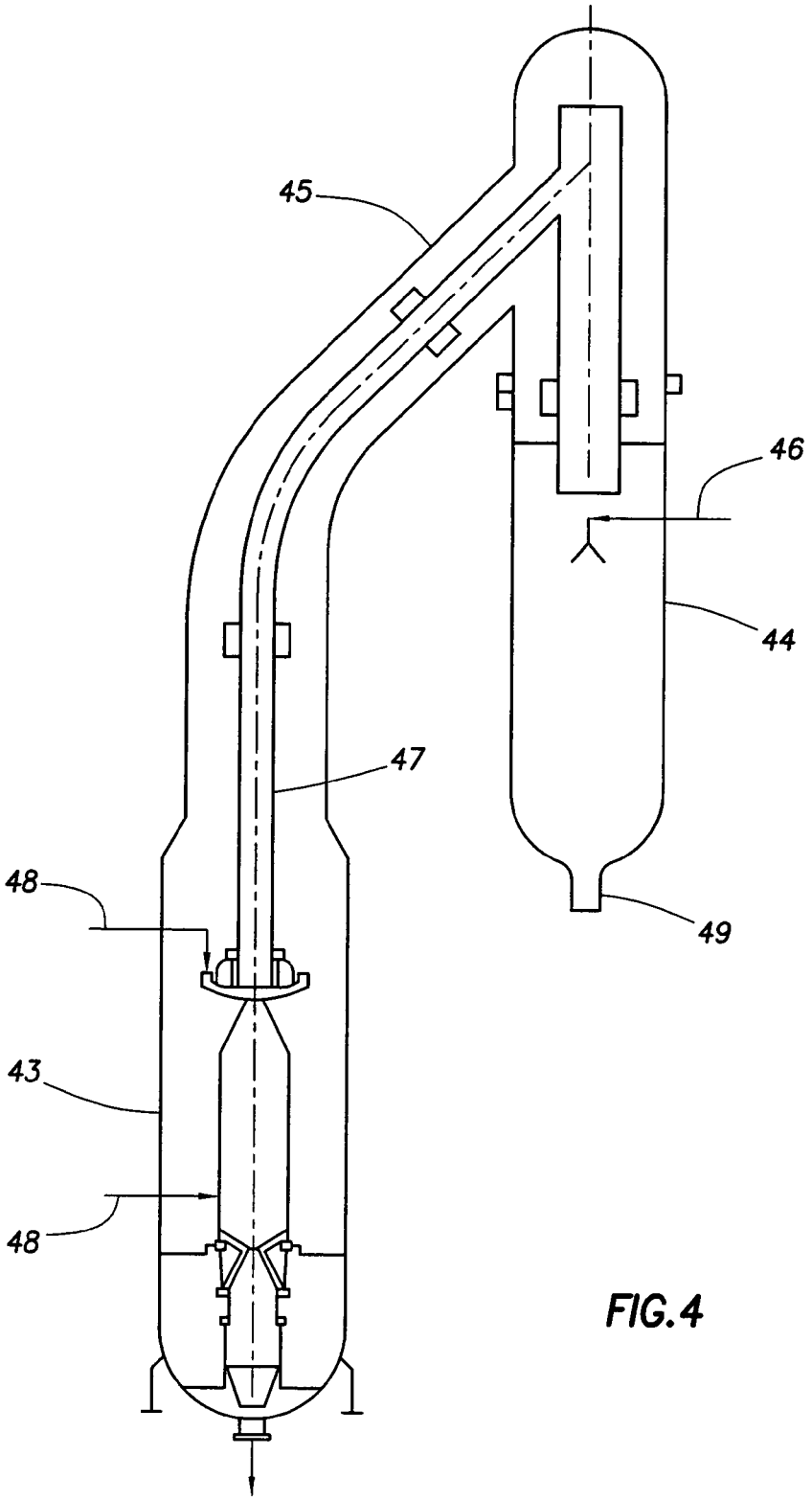
FIG. 4 shows a gasification reactor system for performing a two-step cooling method making use of a downstream separate apparatus.

FIG. 3 illustrates a gasification reactor in which first and second injections may be performed with the same pressure shell, while FIG. 4 illustrates a preferred embodiment wherein the second injection is performed in a separate quench vessel.

FIG. 3 illustrates a gasification reactor comprising the following elements:

- a pressure shell 31 for maintaining a pressure higher than atmospheric pressure;
- an outlet 25 for removing the slag, preferably by means of a so-called slag bath, located in a lower part of the pressure shell 31;
- a gasifier wall 32 arranged inside the pressure shell 31 defining a gasification chamber 33 wherein during operation the synthesis gas can be formed, a lower open part of the gasifier wall 32 which is in fluid communication with the outlet for removing slag 25. The open upper end 34 of the gasifier wall 32 is in fluid communication with a quench zone 35;
- a quench zone 35 comprising a tubular formed part 36 positioned within the pressure shell 31, open at its lower and upper end and having a smaller diameter than the pressure shell 31 thereby defining an annular space 37 around the tubular part 36. The lower open end of the tubular formed part 36 is fluidly connected to the upper end of the gasifier wall 32. The upper open end of the tubular formed part 36 is in fluid communication with the annular space 37 via deflector space 38.

At the lower end of the tubular part 36 injecting means 39 are present for injecting a liquid or gaseous cooling medium. Preferably the direction of said injection as described for FIG. 2 in case of liquid injections. In the annular space 37 injecting means 40 are present to inject a liquid in the form of a mist, preferably in a downwardly direction, into the synthesis gas as it flows through said annular space 37. FIG. 3 further shows an outlet 41 for synthesis gas is present in the wall of the pressure shell 31 fluidly connected to the lower end of said annular space 37. The quench zone is optionally provided with cleaning means 42 and/or 43, which are preferably mechanical rappers, which by means of vibration avoids and/or removes solids accumulating on the surfaces of the tubular part and/or of the annular space respectively.

Amongst advantages of the reactor according to FIG. 3 is its compactness in combination with its simple design. By cooling with the liquid in the form of a mist in the annular space additional cooling means in said part of the reactor may be omitted which makes the reactor more simple. Preferably both via injectors 39 and injectors 40 a liquid, preferably water, is injected in the form of a mist according to the method of the present invention.

FIG. 4 illustrates an embodiment for performing the two-step cooling method making use of a separate apparatus. FIG. 4 shows the gasification reactor 43 based on FIG. 1 of WO-A-2004/005438 in combination with a downstream quench vessel 44 fluidly connected by transfer duct 45. The system of FIG. 4 differs from the system disclosed in FIG. 1 of WO-A-2004/005438 in that the syngas cooler 3 of said FIG. 1 is omitted and replaced by a simple vessel comprising means 46 to add a liquid cooling medium. Shown in FIG. 4 is the gasifier wall 47, which is connected to a tubular part 51, which in turn is connected to an upper wall part 52 as present in quench vessel 44. At the lower end of the tubular part 51 injecting means 48 are present for injecting a liquid or gaseous cooling medium. Quench vessel 44 is further provided with a outlet 49 for cooled synthesis gas. FIG. 4 also shows a burner 50. The burner configuration may suitably be as described in EP-A-0400740, which reference is hereby incorporated by reference. The various other details of the gasification reactor 43 and the transfer duct 45 as well as the upper design of the quench vessel 44 are preferably as disclosed for the apparatus of FIG. 1 of WO-A-2004/005438.

The embodiment of FIG. 4 provides advantages when retrofitting an existing gasification reactor by replacing the syngas cooler of the prior art publications with a quench vessel 44, or when one wishes to adopt the process of the present invention while maintaining the actual gasification reactor of the prior art.

The person skilled in the art will readily understand that the present invention may be modified in various ways without departing from the scope as defined in the claims.

We claim:

1. A method of producing synthesis gas comprising CO, $CO_2$, and $H_2$ from a carbonaceous stream using an oxygen containing stream, the method comprising the steps of:

(a) injecting a carbonaceous stream and an oxygen containing stream into a gasification reactor;

(b) at least partially oxidizing the carbonaceous stream in the gasification reactor, thereby obtaining a raw synthesis gas;

(c) removing the raw synthesis gas obtained in step (b) from an outlet at a top of the gasification reactor into a quenching section located above the gasification reactor; and (d) injecting liquid water into the quenching section in a direction away from the gasification reactor in the form of a mist comprising droplets having a diameter within a range from about 50 to about 200 μm, wherein the water has a temperature of above 150° C., and wherein the water has a temperature of at most 50° C. below a bubble point of the liquid at the pressure of the raw synthesis gas.

2. The method of claim 1, wherein the injected liquid has a temperature within a range from about 200° C. to about 230° C.

3. The method of claim 1, wherein the mist is injected with a velocity within a range from about 30 m/s to about 100 m/s.

4. The method of claim 1, wherein the mist is injected with a velocity within a range from about 40 m/s to about 60 m/s.

5. The method of claim 1, wherein the raw synthesis gas is in the quenching section at a pressure, and wherein the mist is injected with an injection pressure within a range from about 20 bar to about 60 bar above the pressure of the raw synthesis gas.

6. The method of claim 1, wherein the mist is injected in an amount that is selected such that the raw synthesis gas leaving the quenching section comprises at least about 40 vol. % $H_2O$.

7. The method of claim 1, wherein the mist is injected in an amount that is selected such that the raw synthesis gas leaving the quenching section comprises at least about 45 vol. % $H_2O$.

8. The method of claim 6, wherein the raw synthesis gas leaving the quenching section comprises up to about 60 vol. % $H_2O$.

9. The method of claim 7, wherein the raw synthesis gas leaving the quenching section comprises up to about 60 vol. % $H_2O$.

10. The method of claim 6, wherein the raw synthesis gas leaving the quenching section comprises up to about 55 vol. % $H_2O$.

11. The method of claim 7, wherein the raw synthesis gas leaving the quenching section comprises up to about 55 vol. % $H_2O$.

12. The method of claim 1, wherein the quenching section extends about a longitudinal axis, and wherein the mist is injected under an angle within a range from about 30° to about 60° with respect to a plane perpendicular to the longitudinal axis of the quenching section.

13. The method of claim 1, wherein the injected mist is at least partially surrounded by a shielding fluid.

14. The method of claim 13, wherein the shielding fluid is selected from a group consisting of an inert gas including one or more of $N_2$ and $CO_2$, synthesis gas, steam and a combination thereof.

15. The method of claim 1, wherein the raw synthesis gas is first cooled to a temperature below a solidification temperature of the non-gaseous components in the raw synthesis gas by injecting a fluid having a reduced temperature into the raw synthesis gas before performing step (d).

16. The method of claim 1, wherein an upwardly moving flow of raw synthesis gas is first cooled to a temperature below the solidification temperature of the non-gaseous components by injecting a fluid having a reduced temperature into the flow of raw synthesis gas upstream of performing step (d), wherein the flow is subsequently deflected at a more elevated position relative to said injection to a downwardly moving flow of synthesis gas and wherein the injection of the liquid in step (d) is performed into the downwardly moving flow of synthesis gas.

17. The method of claim 16, wherein the fluid comprises liquid water in the form of a mist.

18. The method according to claim 1, further comprising a step of shift converting of the raw synthesis gas leaving the quenching section, whereby at least a part of any water present is reacted with CO to produce $CO_2$ and $H_2$ thereby obtaining a shift converted synthesis gas stream.

19. The method of claim 18, wherein before shift converting the raw synthesis gas, the raw synthesis gas is heated in a heat exchanger against the shift converted synthesis gas stream.

20. The method of claim 18, wherein the mist is heated before injecting it in step (d) by indirect heat exchange against the shift converted synthesis gas stream.

21. The method of claim 1, performed in a gasification reactor comprising:

a pressure shell for maintaining a pressure higher than atmospheric pressure;

a quenching section comprising a tubular formed part positioned within the pressure shell, open at its lower end and its upper end and having a smaller diameter than the pressure shell thereby defining an annular space around the tubular part; and a gasifier wall arranged inside the pressure shell defining a gasification chamber wherein during operation a synthesis gas comprising CO, $CO_2$, and $H_2$ from a carbonaceous stream can be formed using an oxygen containing stream, an open upper end of the gasifier wall being in fluid communication with the quench section;

wherein:

the lower open end of the quenching section is fluidly connected to the upper end of the gasifier wall and the open upper end of the gasifier wall is in fluid communication with the annular space;

an injector is present at the lower end of the tubular part for injecting a fluid cooling medium;

an injector is present in the annular space to inject a liquid in the form of a mist; and an outlet for the synthesis gas is present in the wall of the pressure shell fluidly connected to said annular space.

22. The method of claim 1, performed in a gasification system comprising a gasification reactor and a quench vessel wherein the gasification reactor comprises:

a pressure shell for maintaining a pressure higher than atmospheric pressure;

a quench vessel comprising a quenching section;

a gasifier wall arranged inside the pressure shell defining a gasification chamber wherein during operation a synthesis gas comprising CO, $CO_2$, and $H_2$ from a carbonaceous stream can be formed using an oxygen containing stream, an open upper end of the gasifier wall being in fluid communication with a vertically extending tubular part, which tubular part is open at its lower end and its upper end, the upper end being in fluid communication with a synthesis gas inlet of the quench vessel and wherein the tubular part is provided an injector to add a fluid cooling medium at its lower end;

wherein:

the quench vessel is provided at its top end with a synthesis gas inlet, with an injector to inject a liquid in the form of a mist into the synthesis gas and with an outlet for the synthesis gas.

* * * * *